US005844780A

United States Patent [19]

Deguchi

[11] Patent Number: 5,844,780

[45] Date of Patent: Dec. 1, 1998

[54] PC CARD HAVING A CASING AND A CARD ROTATABLY CONNECTED TO EACH OTHER

[75] Inventor: Manabu Deguchi, Tokyo, Japan

[73] Assignee: NEC Corporation, Tokyo, Japan

[21] Appl. No.: 404,594

[22] Filed: Mar. 15, 1995

[30] Foreign Application Priority Data

Mar. 15, 1994 [JP] Japan ..... 6-069866

[51] Int. Cl.[6] ..... H01R 39/02

[52] U.S. Cl. ..... 361/737; 361/686; 403/65; 403/66; 439/76.1

[58] Field of Search ..... 361/737, 684, 361/686; 174/35 R, 35 TS, 65 R, 64; 439/101, 165, 76.1, 31; 403/65, 66, 70, 71, 184, 182; 16/366, 367

[56] References Cited

U.S. PATENT DOCUMENTS 5,132,492 7/1992 Wieder ..... 174/65 R 5,244,397 9/1993 Anhalt ..... 439/101

5,373,149 12/1994 Rasmussen ..... 235/492

*Primary Examiner*—Leo P. Picard

*Assistant Examiner*—Phuong T. Vu

*Attorney, Agent, or Firm*—Foley & Lardner

[57] ABSTRACT

In a PC card, a casing and a card are rotatably and bendably connected to each other by a hollow connecting member. A flexible wiring member is disposed in the connecting member and electrically connects the casing and card. The connecting member has a rotatable piece received in a first receiving portion formed on one end of the casing, a first cap rotatably supporting the first receiving portion and rotatable piece, an arm inserted at one end thereof in a second receiving portion formed on one end of the card, and a second cap rotatably supporting the second receiving portion and arm. The other end of the arm is bendably connected to the rotatable piece. The casing is freely moved about the arm in the up-and-down and right-and-left directions, as desired. Hence, the casino does not obstruct the operator's access to various switches and so forth arranged on a data terminal while the card is free from loads and damage.

2 Claims, 6 Drawing Sheets

PC CARD HAVING A CASING AND A CARD ROTATABLY CONNECTED TO EACH OTHER

BACKGROUND OF THE INVENTION

The present invention relates to a modem or similar electronic device having a communicating function and constructed integrally with a PC (Personal Computer) card made up of a casing and a card and, more particularly, to a PC card whose casing and card are rotatably connected to each other.

A personal computer or similar small size data terminal is often connected to a communication line in order to interchange data with a remote station. For this kind of communication, use is made of a modem (modulator/demodulator) or similar electronic device constructed integrally with a PC card. The electronic device, or simply PC card as referred to hereinafter, has a card molded or otherwise formed integrally with one end of a casing. In the event of communication, the card of the PC card is inserted into a personal computer or similar data terminal.

The conventional PC card having the above structure has some problems left unsolved, as follows. When the data terminal has various switches, connectors, infrared rays emitting and receiving portions and so forth arranged in the vicinity of a card receiving portion thereof, the casing of the PC card obstructs the operator's access to them or even conceals them. Particularly, to meet the increasing demand for a small size and light weight configuration and advanced functions, the various constituent parts of the data terminal mentioned above are often concentrated around the card receiving portion. In this respect, the casing of the PC card is apt to prevent the operator from manipulating the switches or from connecting the connectors or even to obstruct communication with a remote data terminal.

Generally, the position of the card with respect to the front and rear surfaces in the event of insertion depends on the data terminal. Since the casing and card of the conventional PC card are flush with each other at their bottoms, the casing protrudes, depending on the required orientation, from the bottom of the data terminal and obstructs manipulation. Moreover, the casing protruding from the data terminal causes loads to concentrate on the root portion of the card and, in the worst case, causes the root portion to break. This problem cannot be eliminated unless a particular PC card is prepared for each data terminal.

SUMMARY OF THE INVENTION

It is, therefore, an object of the present invention to provide a PC card which can be mounted to any desired small size data terminal without obstructing the switches and other constituent parts of the terminal and without causing a card thereof from being broken.

In order to achieve the above object, a PC card made up of a casing and a card of the present invention has a hollow connecting member connecting the casing and card such that they are rotatable and bendable relative to each other, and a flexible wiring member electrically connecting the casino and card to each other. Preferably, the connecting member has a first receiving portion formed on one end of the casing, a rotatable piece received in the first receiving portion, a first cap rotatably supporting the first receiving portion and rotatable piece, a second receiving portion formed on one end of the card, an arm inserted in the second receiving portion at one end, and a second cap rotatably supporting the second receiving portion and arm. The other end of the arm is bendably connected to the rotatable piece. More preferably the first receiving portion and the rotatable piece respectively have stops on the inner periphery and the outer periphery thereof and capable of abutting against each other, while the second receiving portion and the arm respectively have stops on the inner periphery and the outer periphery thereof and capable of abutting against each other.

In the above construction, the rotatable piece and arm are bendable relative to each other. In addition, the piece and first receiving portion and the arm and second receiving portion are rotatably supported. Hence, the casing can be freely moved about the arm in the up-and-down and right-and-left directions, as desired. The casing, therefore does not obstruct the access to various switches arranged on a data terminal while the card is free from loads and damage.

Further, the stops prevent the wiring member in the connecting means from being twisted more than expected and snapped off.

BRIEF DESCRIPTION OF THE DRAWINGS

The above and other objects, features and advantages of the present invention will become apparent from the following detailed description when taken with the accompanying drawings in which:

FIGS. 4A and 4B are views respectively similar to FIGS. 3A and 3B and showing a connecting arrangement included in a card forming another part of the embodiment;

DETAILED DESCRIPTION OF THE PREFERRED EMBODIMENT

Figure 1:
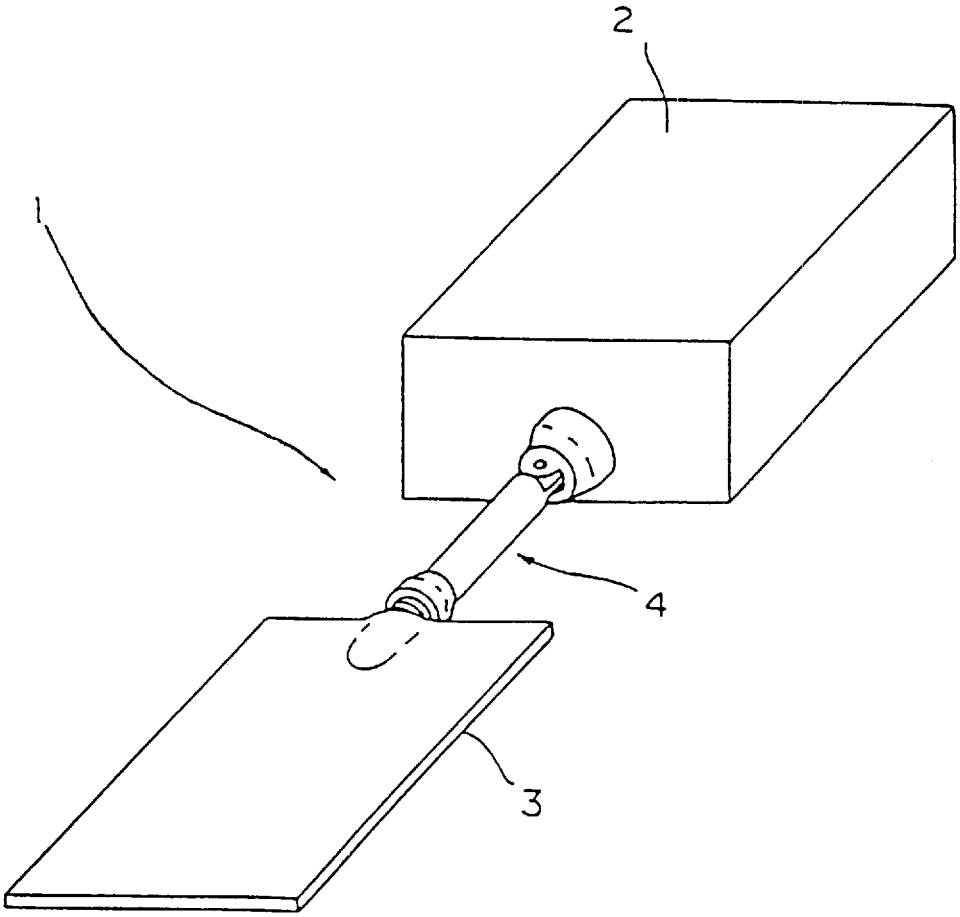
FIG. 1 is a perspective view of a PC card embodying the present invention.
Figure 2:
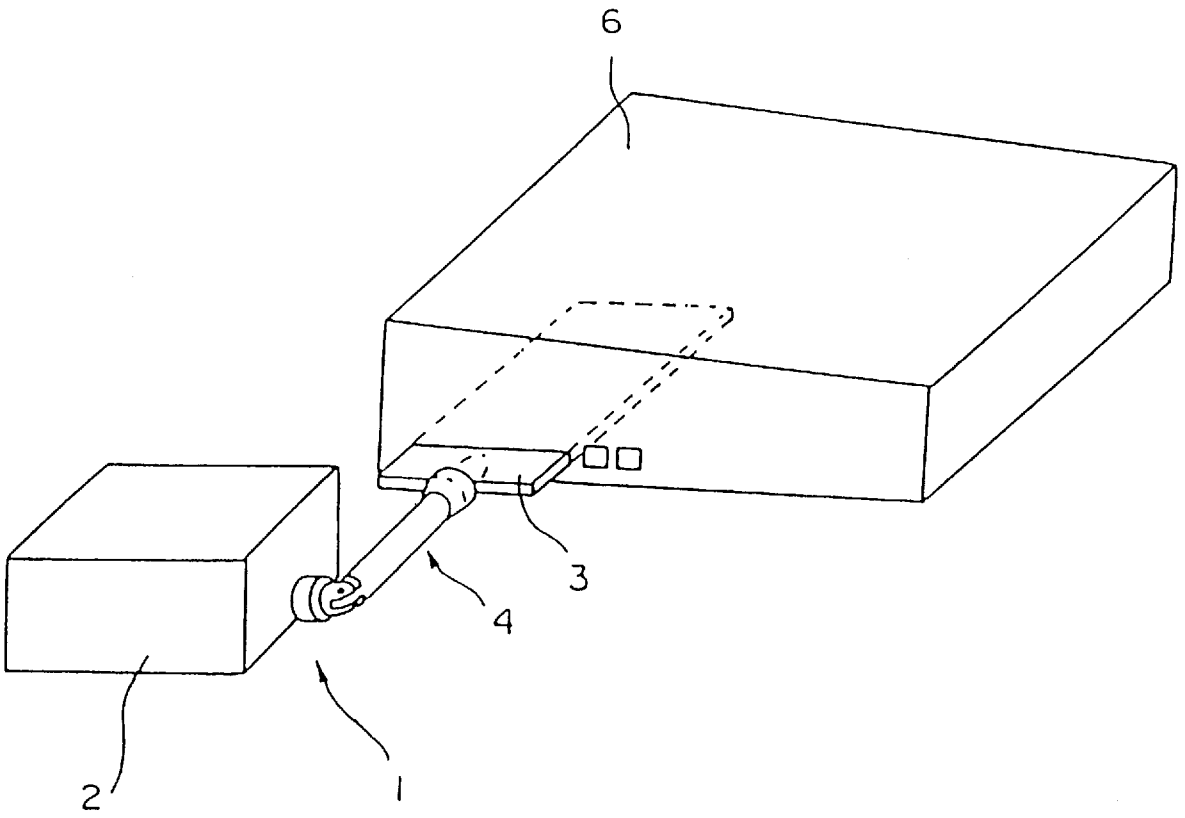
FIG. 2 is a perspective view showing the PC card of FIG. 1 mounted to a small size data terminal.
Figure 3A:
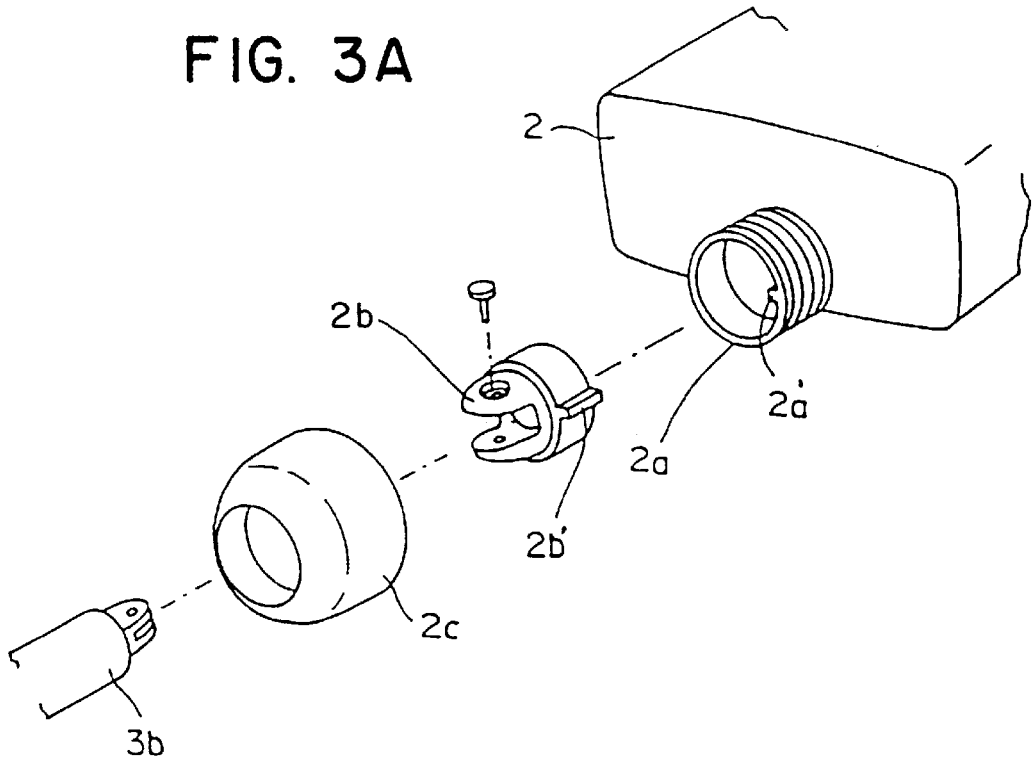
FIGS. 3A and 3B are respectively an exploded perspective view and a sectional plan view of a connecting arrangement included in a casing forming part of the embodiment.
Figure 3B:
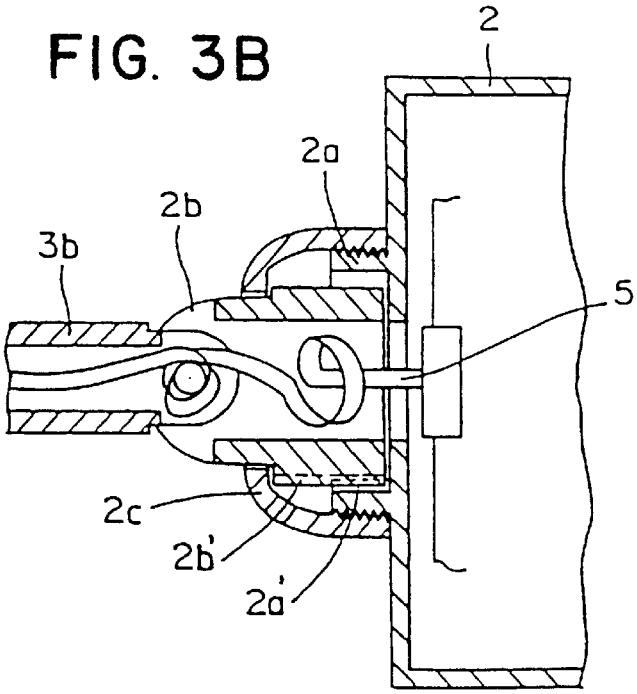
Figure 4A:
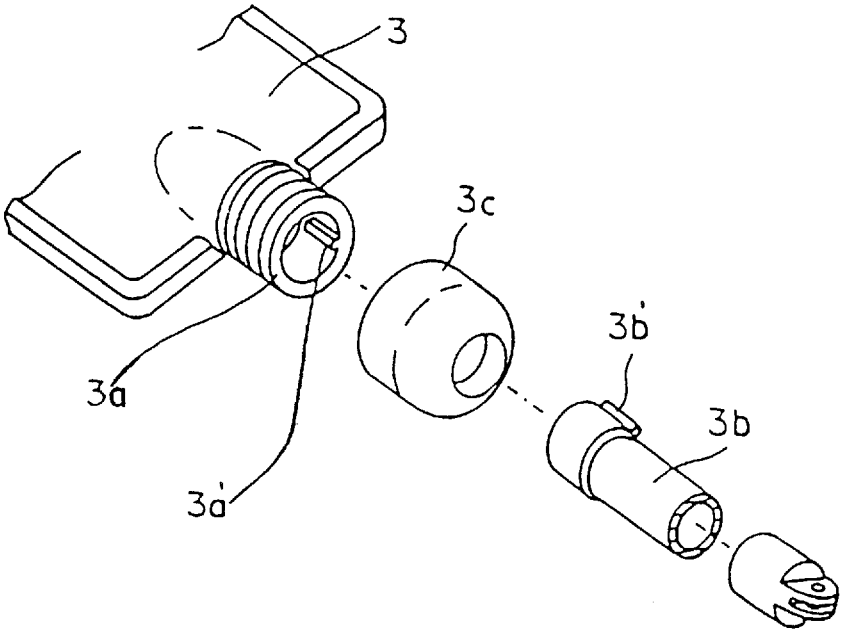
Figure 4A:
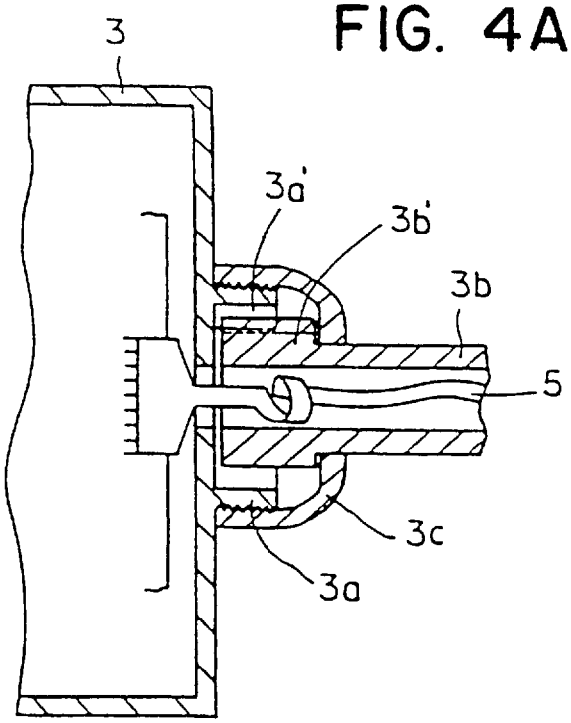

Referring to FIGS. 1 and 2, a PC card embodying the present invention is shown and generally designated by the reference numeral 1. As shown, the PC card 1 is made up of a casing 2 accommodating equipment for data transmission and reception, a card 3 to be removably mounted to, for example, a small size data terminal 6, and a hollow connecting member 4 connecting the casing 2 and card 3. A wiring member, which will be described later, is disposed in the hollow connecting member 4 and electrically connects the casing 2 and card 3.

As shown in FIGS. 3A, 3B, 4A and 4B, the casing 2 is formed with an annular projection, or first receiving portion as referred to hereinafter, 2*a* at one end thereof. The first receiving portion 2*a* is communicated to the inside of the casing 2 and formed with a screw-thread on the outer periphery thereof. The connecting member 4 includes a rotatable piece 2*b* to be received in the receiving portion 2*a*, and a first cap 2*c* implemented as a cap nut. When the first cap 2*c* is brought into threaded engagement with the receiving portion 2*a*, it rotatably supports the piece 2*b*. An arm 3*b* is inserted at one end thereof into an annular projection, or second receiving portion, 3*a* which is formed at one end of the card 3. The second receiving portion 3*a* is communicated to the inside of the card 3 and also formed with a screw-thread on the outer periphery thereof. When a second cap or cap nut 3*c* is threaded over the receiving portion 3*a,* it rotatably supports the arm 3*b*.

The rotatable piece 2*b* of the connecting member 4 has a flange at one end thereof. The outside diameter of the piece 2*b*, including the flange, is selected to be at least smaller than the inside diameter of the first receiving portion 2*a* of the casing 2. Stops 2*a*' and 2*b*' are respectively formed on the inner periphery of the receiving portion 2*a* and the outer periphery of the rotatable piece 2*b* and capable of abutting against each other. The first cap 2*c* for rotatably supporting the piece 2*b* has a hollow hemispherical configuration which is open at opposite ends. The inner periphery of the cap 2*c* is screw-threaded at one end so as to mate with the first receiving portion 2*a*. When the rotatable piece 2*b* is received in the receiving portion 2*a* at one end, it protrudes through the other end of the cap 2*c* at the other end. The opening of the cap 2*c* through which the piece 2*b* protrudes is so sized as to prevent the flange of the piece 2*b* from slipping out. In this condition, the piece 2*b* is freely rotatable substantially 360 degrees about its own axis. It is to be noted that the hemispherical configuration of the cap 2*c* is only illustrative and may be replaced with for example, a cylindrical or rectangular configuration.

The end portion of the arm 3*b* to be received in the second receiving portion 3*a* of the card 3 has a flange like the rotatable piece 2*b*. This end portion of the arm 3*b*, including the flange, has an outside diameter at least smaller than the inside diameter of the receiving portion 3*a*. Stops 3*a*' and 3*b*' are respectively formed on the inner periphery of the receiving portion 3*a* and the outer periphery of the arm 3*b* and capable of abutting against each other.

The second cap 3*c,* like the first cap 2*c*, has a hollow hemispherical configuration which is open at opposite ends thereof. The inner periphery of the cap 3*c* is screw-threaded at one end so as to mate with the second receiving portion 3*a*. When the end of the arm 3*b* is received in the receiving portion 3*a* at one end, it protrudes through the other end of the cap 3*c* at the other end. The opening of the cap 3*c* through which the arm 3*b* protrudes is so sized as to prevent the flange of the arm 3*b* from slipping out. In this condition, the arm 3*b* is also freely rotatable substantially 360 degrees about its own axis. Again, the hemispherical configuration of the cap 3*c* is only illustrative and may be replace with any other suitable configuration.

Further, the other end of the arm 3*b* remote from the receiving portion 3*a* is hinged to the rotatable piece 2*b*. Therefore, the arm 3*b* can freely turn at least 180 degrees relative to the piece 2*b*. The hinge connecting the arm 3*b* to the piece 2*b* may be replaced with, for example, a ball bearing, if desired.

Figure 5:
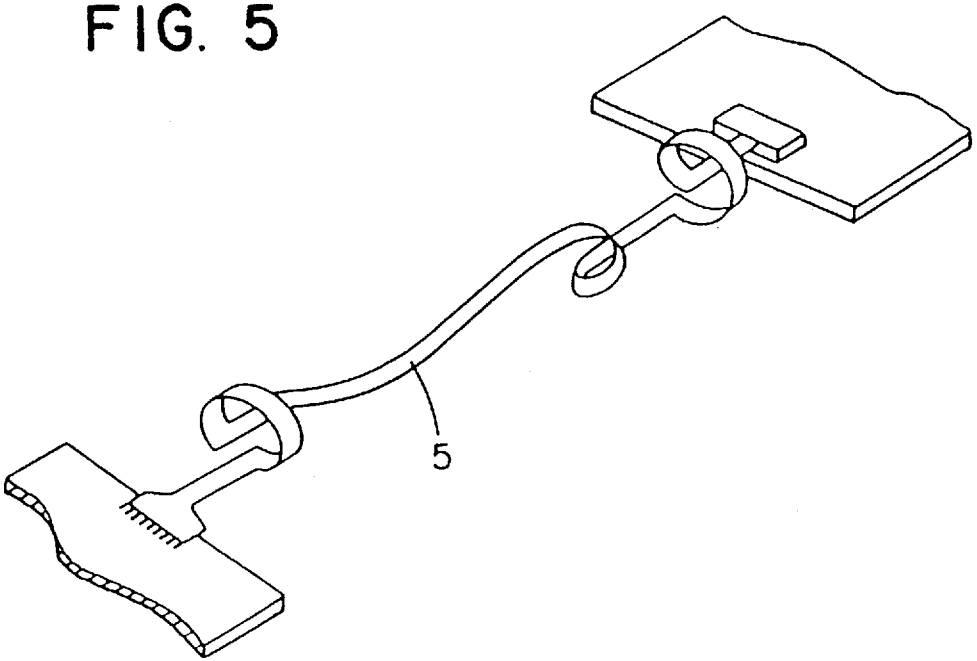
FIG. 5 is a perspective view of a wiring member also included in the embodiment.

The wiring member 5 is disposed in the connecting member 4 having the above configuration and electrically connects the casing 2 and card 3. The wiring member 5 is implemented by a flexible printed circuit board and deformable when the rotatable piece 2*b* and arm 3*b* rotate and bend. As shown in FIG. 5, the wiring member 5 is turned around the rotating and bending portions of the piece 2*b* and arm 3*b* for an allowance purpose. The electrical connection may be set up by leads or the like in place of the flexible printed circuit board, if desired.

Figure 6:
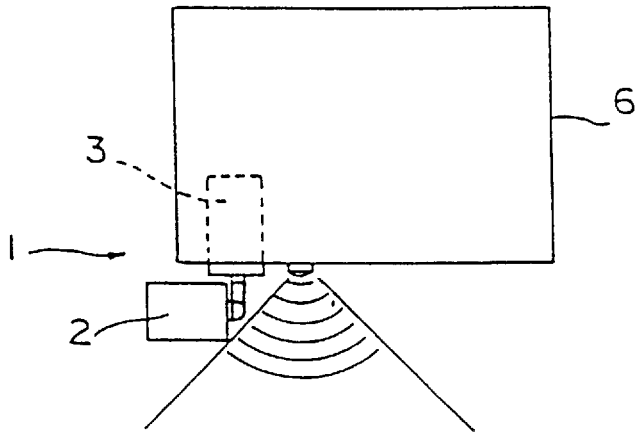
FIG. 6 is a plan view of the PC card mounted to the data terminal.

In the construction described above, the rotatable piece 2*b* and arm 3*b* are bendable relative to each other via the hinge. In addition, the piece 2*b* and first receiving portion 2*a* and the arm 3*b* and second receiving portion 3*a* are rotatably supported by the caps 2*c* and 3*c,* respectively. Hence, when the card 3 is inserted into the data terminal 6, the casing 2 can be freely moved about the arm 3*b* in the up-and-down and right-and-left directions, as desired. As shown in FIG. 6, the casing 2 does not obstruct the access to various switches arranged on the data terminal 6 while the card 3 is free from loads and damage.

Moreover, the stops 2*a*' and 2*b*' of the first receiving portion 2*a* and rotatable piece 2*b*, respectively, and the stops 3*a*' and 3*b*' of the second receiving portion 3*a* and arm 3*b*, respectively, each cooperates to prevent the piece 2*b* or the arm 3*b* from rotating more than 360 degrees. This prevents the wiring member 5 in the connecting member 4 from being twisted more than expected and snapped off.

What is claimed is:

1. An electronic device, comprising:

a casing;

a card;

a hollow connecting member mechanically connecting said casing and said card such that said casing and said card are rotatable and bendable relative to each other; and a flexible wiring member electrically connecting said casing and said card to each other, wherein said hollow connecting member comprises:

a first receiving portion formed on one end of said casing;

a rotatable piece received in said first receiving portion;

a first cap rotatably supporting said first receiving portion and said rotatable piece;

a second receiving portion formed on one end of said card;

an arm having a first end inserted in said second receiving portion; and a second cap rotatably supporting said second receiving portion and said arm;

said arm having a second end bendably connected to said rotatable piece.

2. An electronic device as claimed in claim 1, wherein said first receiving portion and said rotatable piece respectively have stops on an inner periphery and an outer periphery thereof for abutting each other, and wherein said second receiving portion and said arm respectively have stops on an inner periphery and an outer periphery thereof for abutting each other.

* * * * *